7/28/87 XR 4,682,612

United States Patent [19]

Giuliano

[11] Patent Number: 4,682,612

[45] **Date of Patent: * Jul. 28, 1987**

[54] NOVEL PROCESS AND ARTICLE FOR PREPARING ARTIFICIAL NAILS

[75] Inventor: James T. Giuliano, Ft. Lauderdale, Fla.

[73] Assignee: Zotos International, Inc., Darien, Conn.

[ * ] Notice: The portion of the term of this patent subsequent to Jun. 24, 2003 has been disclaimed.

[21] Appl. No.: 522,536

[22] Filed: Aug. 12, 1983

[51] Int. Cl.[4] ..... A45D 40/30

[52] U.S. Cl. ..... 132/73; 132/88.5; 424/61; 350/311

[58] Field of Search ..... 132/73, 88.5; 424/61; 350/311, 1.1; 206/45.14

[56] References Cited

U.S. PATENT DOCUMENTS

| | | | |
|---|---|---|---|
| 2,887,116 | 5/1959 | Wooding | 132/73 |
| 3,157,912 | 11/1964 | Lisczawka | 18/5.1 |
| 3,245,418 | 4/1966 | Dinerstein | 132/88.5 |
| 3,382,878 | 5/1968 | Dinerstein | 132/88.5 |
| 3,478,756 | 11/1969 | Sautter et al. | 132/73 |
| 3,502,088 | 3/1970 | Jaiby | 132/73 |
| 3,750,684 | 8/1973 | Russell | 132/88.5 |
| 3,896,014 | 7/1975 | Rosenberg | 204/159.23 |
| 3,928,113 | 12/1975 | Rosenberg | 132/73 |
| 4,058,442 | 11/1977 | Lee et al. | 204/159.12 |
| 4,104,333 | 8/1978 | Lee et al. | 260/885 |
| 4,126,144 | 11/1978 | Duarte | 132/73 |
| 4,132,234 | 1/1979 | Bradley | 132/73 |
| 4,156,066 | 5/1979 | Gould | 528/73 |
| 4,172,461 | 10/1979 | Pangburn | 132/73 |
| 4,260,701 | 4/1981 | Lee | 525/303 |
| 4,273,145 | 6/1981 | Lester et al. | 132/73 |
| 4,287,899 | 9/1981 | Robichaud | 132/73 |
| 4,408,622 | 10/1983 | Meyerhoefer et al. | 132/73 |
| 4,596,260 | 6/1986 | Giuliano | 132/73 |

OTHER PUBLICATIONS

Barbara Ayash, The Professional Manicurist's Handbook, Artificial Nail Systems, Inc., Tarzana, California, (1976).

*Primary Examiner*—William R. Dixon, Jr.
*Assistant Examiner*—Prezlock, Cynthia A.
*Attorney, Agent, or Firm*—Haynes N. Johnson; George W. Rauchfuss, Jr.

[57] ABSTRACT

Novel procedures for preparing artificial nails employing coating compositions which are cured in the presence of ultraviolet light to provide hard, flexible artificial nails having the general appearance of natural nails, which procedures can be used with the known prior art forms; and novel forms or molds for use in preparing artificial nails which are particularly useful with the aforementioned novel procedures but which can be employed with the prior art techniques for coating artificial nail compositions on a digit.

27 Claims, 12 Drawing Figures

NOVEL PROCESS AND ARTICLE FOR PREPARING ARTIFICIAL NAILS

BACKGROUND OF THE INVENTION

Artificial nails are well known and commonly employed, mainly by women desiring the appearance of having longer finger nails than their natural ones and/or to repair or obscure a broken nail. Generally speaking, the artificial nails of the prior art can be characterized as falling into one of the following two classes: (1) preformed nails; and (2) nails which are applied as a viscous solution or paste with the aid of a suitable form affixed to the digit during application.

As examples of preformed artificial nails, mention may be made of those described and claimed in U.S. Pat. Nos. 2,633,139; 2,746,460; 2,764,166; 2,979,061; 3,277,900; 3,487,831; 3,552,401; and 4,106,614.

Generally speaking, preformed nails such as would be purchased in a package have an inadequately short life. Whether they are provided with an adhesive backing or applied with the aid of an adhesive coating composition, they tend to break off or separate from the natural nail too shortly after application. Moreover, preformed nails usually are not the precise size, particularly when one desires to apply artificial nails to less than all of the digits. In other words, they frequently do not have the "natural" look of the real nail, especially when comparison is made with a natural nail on another digit.

Consequently, virtually all artificial nails applied by professional beauticians fall into the latter class, i.e. application by brushing or "painting" on a suitable artificial nail composition with the aid of a form secured to the digit. After the composition has hardened, the form is removed. Artificial nail procedures of this latter class are described and claimed, for example, in U.S. Pat. No. 3,478,756.

Since the present invention is directed to novel procedures and articles for providing artificial nails by the latter techniques, these procedures heretofore employed in the art for coating arificial nails onto the digit will now be described in more detail for a better understanding of the nature and objects of this invention.

In a typical commercial procedure such as would be employed by a manicurist in a beauty salon, any existing nail polish is first removed and the nail is then lightly sanded to remove the shiny nail surface (top layer). A nail form such as is shown in FIG. 1 and which will be discussed in more detail hereinafter, is then placed on the finger. After the form is securely in place, a primer coating is applied to the natural nail with a small brush to increase adhesion of the applied artificial nail. After the volatile solvent for the primer has evaporated, a so-called "white tip" is then applied over the primer by first dipping the brush into a suitable organic solution, then picking up a ball of powder to form a paste which is rapidly applied in a series of steps, first on the form beyond the natural nail tip and then over the natural nail. Polymerization and hardening to form the plastic artifical nail occurs very rapidly in situ once the solution and powder are admixed and the operator must be highly skilled and move rapidly to shape this "white tip" into the desired shape of the nail. Controlling the amount of the liquid on the brush is a very critical part of this step and moreover care should be taken not to touch the natural nail with one's fingers to avoid transfer of oil and moisture which may cause the artificial nail not to adhere properly.

Following application of the "white tip", a clear top coat of plastic is applied over the natural and artificial nails to increase the strength of the bond of the extended artificial nail to the natural nail and to give a smooth uniform appearance. The nail is then finished by removing the form, sanding, shaping, cleaning and, if desired, application of nail polish.

Because the polymerization and hardening to form the artificial nail occurs in situ shortly after admixture of the ingredients including the monomers, polymerization catalyst, etc, and the practitioner therefore has no control over the timing thereof, the artificial nails must be applied sequentially. A typical such procedure may take, for example, on the order of an hour and a half by a skilled operator to apply nails to all ten fingers.

These prior art procedures suffer from certain noted deficiencies. The operator must be trained and skilled in the shaping of the artificial nail in the short time between mixing the ingredients and hardening. As mentioned, each nail must be applied sequentially and further time is required for the finishing touches. Moreover, the known commercial procedures require the use of volatile organic solvents, the disadvantages of which will be readily apparent. For instance, some operators and/or their clients find the odor extremely objectionable. Technical problems may also occur. For example, occasionally the monomers in the composition do not polymerize uniformly.

In addition to the above-noted difficulties, the applied artificial nail is usually thicker in appearance and can therefore be detected on closer scrutiny. Further, they tend to soften the underlying natural nail. Other problems which sometimes occur include allergic reaction to the artificial nail composition, water mold, fungus, and lifting or separation of the artificial nail.

SUMMARY OF THE INVENTION

The present invention is directed to obviating the aforementioned problems, thereby providing greatly improved techniques for the application of artificial nails to the digits.

In one aspect, the present invention contemplates novel procedures for forming artificial nails on the digits utilizing per se known organic solvent-free photopolymerizable compositions, the photopolymerization being initiated in the presence of a so-called black light wherein amy potentially harmful short wavelength light has been eliminated. These procedures may be employed in conjunction with any of the pre-existing forms heretofore known in the art or commercially available for the preparation of artificial nails.

However, the present invention also contemplates providing novel forms or molds which conform substantially to the size and shape of the desired artificial nail extension and which materially simplify the process. While in the preferred embodiments these novel forms are used in combination with the novel processes of this invention, the forms may also be employed with any of the artificial nail coating compositions such as were heretofore available.

DETAILED DESCRIPTION OF THE INVENTION

As was previously mentioned, the prior art compositions for coating artificial nails are applied as a viscous organic solution or paste. In such procedures, the beautician or other practitioner is provided essentially with two sets of ingredients: (1) an organic solvent or solution; and (2) a mixture of solids to be added to the organic liquid component. These ingredients are essentially quite stable during shelf life. However, once they are admixed, curing and solidification at room temperature occur fairly rapidly and the practitioner must accordingly coat or "paint" this composition rapidly and skillfully before it hardens. Consequently, only one nail at a time can be provided.

Prior art procedures of this general description are disclosed, for example, in the aforementioned U.S. Pat. No. 3,478,756. As disclosed therein, the coating composition may comprise acrylic resins such as, for example, a mixture of polymethylmethacrylate and methylmethacrylate which are cured or solidified in the presence of a catalyst. A typical catalyst for this purpose is a redox catalyst system, one component of which is stored seaparately prior to use. Once they are admixed, curing commences. The composition may also contain additional ingredients performing specific desired functions, e.g. reagents for improving or enhancing adhesion of the acrylic resin to the natural nail, plasticizers for softening the artificial nail, various reagents for improving the appearance such as opalescence-providing materials, whitening agents such as titanium dioxide or other pigments, dyes, natural or synthetic pearl essence, etc.

Figure 1:
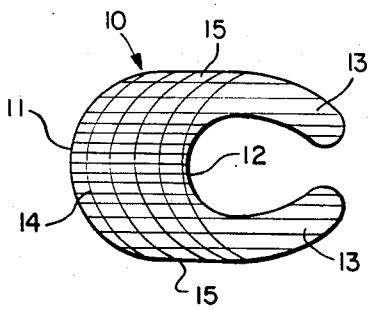
FIG. 1 (PRIOR ART)
FIG. 1 is a plan view of a typical form of the prior art.

A typical form to facilitate application of such a coating composition is shown in FIG. 1. The form 10 is illustrated to have a forward or leading end 11, a rear or trailing end 12 and lateral sides 15. Leading end 11 is generally arcuate to conform in shape essentially to the tip of the artificial nail extension and trailing end 12 is also generally arcuate to conform essentially to the shape of the tip of the digit. Form 10 is also shown to have a pair of fingers 13 projecting along the lateral edges rearwardly from trailing end 12. The form may be provided with a series of generally arcuate printed guidelines to assist the practitioner in providing the desired length of the artificial nail extension. Form 10 may be made of any suitable material, e.g. metal foil, a plastic sheet material such as a polyester, or laminates of the two, it being understood of course that the form must be flexible and readily separable from the cured nail composition.

Preferably, the underside is provided with a pressure-sensitive adhesive (not shown) to provide better adherance to the digit, in which event the form would typically come provided with the adhesive backing affixed to the conventional release sheet such as kraft paper or the like.

Figure 2:
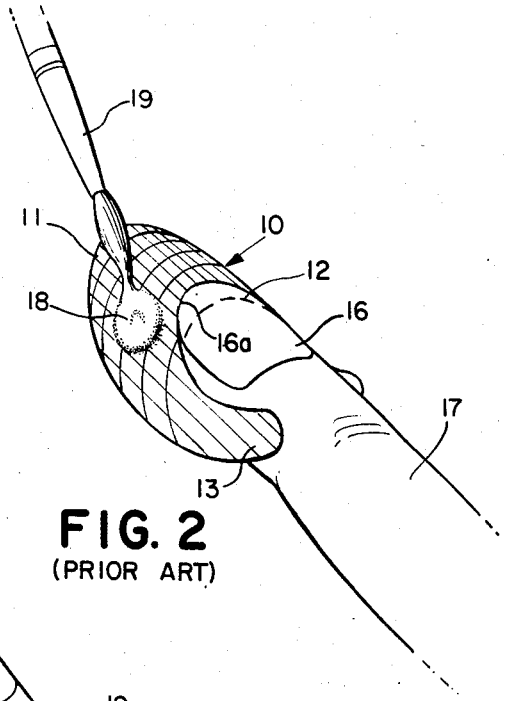
FIG. 2 (PRIOR ART)
FIG. 2 is a perspective view illustrating the prior art procedures employing the form of FIG. 1.

The preparation of an artificial nail under these prior art procedures, including the form of FIG. 1, is illustrated in FIG. 2. Form 10 is separated from the release sheet and the pressure-sensitive adhesive surface is placed on finger 17 with the fingers of the form 13 gripping opposed sides of the digit and the trailing end 12 of the form placed under the tip 16*a* of the real nail 16. With the form in place, the various coating compositions are then applied. This is customarily done with the aid of a brush. The practitioner dips brush 19 into the liquid component and then into the solid component to form a bead 18 which is first applied on form 10 beyond tip 16*a* of the natural nail and quickly shaped into the artificial nail extension. One or more additional beads are then applied over the entire surface of nail 16 to give a uniform appearance. After the organic solvent has evaporated and the nail has hardened, the form is carefully removed and the nail is finished with the usual filing or sanding to shape, cleaning, polishing, etc. The procedure is repeated for each successive finger, as desired.

In contrast with these prior art procedures, one aspect of the present invention, as was previously mentioned, contemplates the use of photopolymerizable compositions, i.e. compositions wherein curing to form the hard artificial nail is initiated by actinic radiation. In general, the prior art, both the patent literature and polymer texts, is replete with reference to such compositions and they are accordingly not novel in the context of the present invention. Typically, these prior art compositions may include at least one suitable polymer or oligomer, a photoinitiator and a liquid monomer in which the various other ingredients are soluble, the monomer being cross-linkable with the polymer in the presence of actinic radiation, e.g. ultraviolet (UV) radiation to form the desired solid plastic. As is understood in the art, the degree of firmness is in part dependent upon the degree of cross-linking and one skilled in the art understands that varying the ratio of monomer to polymer can provide greater or lesser firmness or rigidity of the product. In general, these liquid compositions may be characterized as being solvent-free and possessing an excellent shelf life, being capable of being stored in the absence of actinic radiation for long periods of time.

The photopolymerizable compositions for use in the present invention are characterized as being free from volatile or toxic components and they should not, of course, contain any skin irritants. Upon curing, they should provide an artificial nail which is hard but has a degree of flexibility comparable to natural nails so as to minimize the likelihood of breaking upon contact with hard objects. The cured product should also be water-insoluble and should not be affected by contact with detergents, e.g. the ordinary household detergents one typically encounters. Further, the cured product should provide a smooth, preferably shiny, uniform coating which is esthetically pleasing and will readily accept the nail polishes or lacquers customarily used. Preferably, the composition should adhere well directly to the natural nail without the aid of tie coats, base coats or the like. It should also be easily cut or sanded to shape.

All of the foregoing characteristics will be readily apparent to one skilled in the art in the light of the present description. Likewise, one skilled in the art will readily understand and appreciate the various classes of ingredients heretofore known and used in the photopolymerizable polymer art which may be selected for use in the present invention. Accordingly, these ingredients need not be discussed in any great detail.

The liquid monomers which may be used may be selected from a long list of those heretofore employed in the art, the methacrylates being particularly preferred. Included are both mono- and poly-functional monomeric materials, the latter having more reactive sites to increase the crosslink density. [As will be appreciated, this is a useful way of varying the degree of hardness according to one's particular desires.] Partially polymerized monomers as well as mixtures of monomers are also contemplated.

As examples of monomers heretofore employed and which may be useful, mention may be made of butanediol dimethacrylate, butoxyethyl methacrylate, butyl methacrylate, diethylaminoethyl methacrylate, diethylene glycol dimethacrylate, dimethylaminoethyl methacrylate, ethylene glycol dimethacrylate, 2-ethylhexyl methacrylate, ethoxyethyl methacrylate, glycidyl methacrylate, hydroxyethyl methacrylate, hydroxypropyl methacrylate, methyl methacrylate, neopentyl glycol dimethacrylate, polyethylene glycol dimethacrylate, tert.-butylaminoethyl methacrylate, triethylene glycol dimethacrylate, tetrahydrofufuryl methacrylate and trimethylolpropane trimethacrylate. Other monomers which may be used include acrylates such as butylene glycol diacrylate, n-butylacrylate, diethylaminoethyl acrylate, 2-ethylhexyl acrylate, ethoxyethyl acrylate, hexanediol diacrylate, polyethylene glycol diacrylate, phenoxyethyl acrylate, pentaerythritol triacrylate, trimethylolpropane triacrylate, triethylene glycol diacrylate, etc.; acrylamides such as N-isobutoxymethylacrylamide, N-methylolacrylamide, N,N,-dimethylacrylamide, N,N,-methylene bisacrylamide, etc.; allyl monomers such as allyl glycidyl ether, allyl methacrylate, diallyl phthalate, etc.; as well as various other monomers known in the art, including vinyl monomers, glycidyl ethers and the like.

The polymers that may be used include the commercially available low molecular weight oligomers, e.g. urethanes such as those having a molecular weight ranging from about 600 to about 8000 and containing no reactive isocyanate groups, the epoxies and the polymethacrylates, the urethanes, especially the acrylated urethanes being particularly preferred. As an example of a commercially available urethane oligomer, mention may be made of "Uvithane" (trademark of Thiokol Specialty Chemical Division).

Useful photoinitiators are also well known in the art and include the aromatic ketones such as benzophenone, diethoxyacetophenone, benzil and anthraquinone; halogenated aromatic ketones such as the chlorinated benzophenones and chlorothioxanthone; as well as other well known photoinitators.

The compositions which may be employed may include mixtures of more than one ingredient from each group. Additional reagents performing specific desired functions may also be added, e.g. flow control agents, slip aids and the like, as well as dyes, pigments and the like such as those heretofore used for appearance.

As examples of useful formulations, mention is made of:

| Ingredient | Parts by Weight |
|---|---|
| Example 1 | |
| Urethane Methacrylate | 60 |
| Polymethylmethacrylate | 5 |
| Trimethylolpropane trimethacrylate | 10 |
| Isobutoxymethylacrylamide | 10 |
| Dimethoxyphenylacetone | 5 |
| N—Vinylpyrollidone | 10 |
| Example 2 | |
| Epoxy Methacrylate | 60 |
| Carboxyl terminated polybutadiene/acrylonitrile | 5 |
| Trimethylolpropane trimethacrylate | 5 |
| N—Vinylpyrollidone | 10 |
| Bisphenol A Ethoxylate Dimethacrylate | 15 |
| Benzophenone | 5 |

The artificial nail compositions of the foregoing description are distinguishable both chemically and in function or use from the photocurable liquid nail lacquer compositions which are described and claimed in U.S. Pat. Nos. 3,896,014 issued July 22, 1975 and 3,928,113 issued Dec. 23, 1975. U.S. Pat. No. 3,896,014 relates to certain photocurable nail lacquers comprising a polyene, a polythiol, a photocuring rate accelerator, and a surfactant from a particular class, the composition being curable to a hard nail finish when exposed to actinic light. However, unlike the artificial nail compositions contemplated for use in the present invention, the lacquers described in the patent are readily removable by soaking the nails in warm water. They would accordingly not be useful in the practice of the present invention. While mention is made in the patent (col. 4) that the lacquer may be used without employing a base or tie coat, in the illustrative examples a tie coat was employed. U.S. Pat. No. 3,928,113, which issued from a continuation-in-part thereof, relates to a two-part nail coating system comprising as a first part (a), a basecoat composition of a water-soluble or water-swellable polymer in a solvent and as a second part (b), a photocurable nail lacquer composition as disclosed in the parent application which issued as the aforementioned U.S. Pat. No. 3,896,014. The nail polish composition is removed by placing the nails in hot water for 3–5 minutes and then peeling.

Accordingly, while relevant as further showing the state of the art, it is seen that these patents relate to an entirely different inventive task directed to the nail polish art, the resulting lacquers which are said to solve the task being readily removable in water and therefore not applicable for use in the present invention requiring the use of cured compositions which are of a far more lasting and permanent nature, being removable with the aid of an organic solvent such as acetone, but not with water, liquid detergents and the like.

In use, the compositions contemplated by the present invention may be applied to the digit in the manner previously described with the aid of a form of the prior art such as is shown in FIGS. 1 and 2. However, unlike the prior art procedures, since curing does not occur until the digit with the applied composition is placed under a suitable light source, the operator is not pressured to work very rapidly and can apply the composition to a plurality of digits, as desired, before curing.

Only after all of the digits sought to be provided with artificial nails are so coated need exposure to the curing light source be made. The ability to provide a plurality of artificial nails in a batch operation rather than sequentially is a very significant time-saver and therefore an important advantage derived from the present invention.

While in theory any of the light sources including the commercially available UV lights can be employed to effect curing and thereby form the artificial nail, it will be appreciated that care should be exercised to avoid any harmful effects from the radiation to either the operator or the person to whom the nails are applied. For this reason, an important aspect of the present inventive process, in its most preferred form, is the use of a so-called blacklight which emits radiation in a specific range of the spectrum to obviate any dangers inherent in the use of UV.

To fully understand this preferred aspect of the invention, it is appropriate briefly to discuss ultraviolet radiation in general.

Ultraviolet light, or more correctly, ultraviolet radiation, is a form of energy that occupies a small portion of the electromagnetic spectrum. This spectrum ranges from the highest energy (shortest wavelength) cosmic rays to the lowest energy (longest wavelength) radio waves. UV, which is at the near end of the visible spectrum, has been commonly divided into three regions: (1) short wavelength (UV-C) ranging from 180 to 280 nm; (2) medium wavelength (UV-B) ranging from 280 to 320 nm; and (3) long wavelength (UV-A) ranging from 320 to 380 nm. While lamps producing ultraviolet radiation in all three of these regions are commercially available, it is well known that safety precautions should be observed near and around sources of short wave (UV-C) or medium wave (UV-B) radiation. Failure to protect the eyes and skin can result in discomfort such as painful "sunburning".

Long wavelength (UV-A), also referred to as near-ultraviolet, is often called "Blacklight" because of its capability of exciting various substances, causing them to fluoresce. Blacklight energy is generally regarded as not being harmful. However, blacklight energy alone (without visible light) from blacklight lamps causes the eye media to fluoresce, producing sensations that have been described as unusual or uncomfortable. This fluorescence of the eye media is temporary, existing for the time of exposure and producing no known after effects. While it is generally accepted that normal levels of blacklight energy are not harmful to the average, healthy person, abnormally high levels of energy, long term exposure, abnormal natural sensitivity or abnormal sensitivity provided by sensitizing agents (drugs or chemicals) to this energy may produce eye and/or skin irritations.

Figure 12:
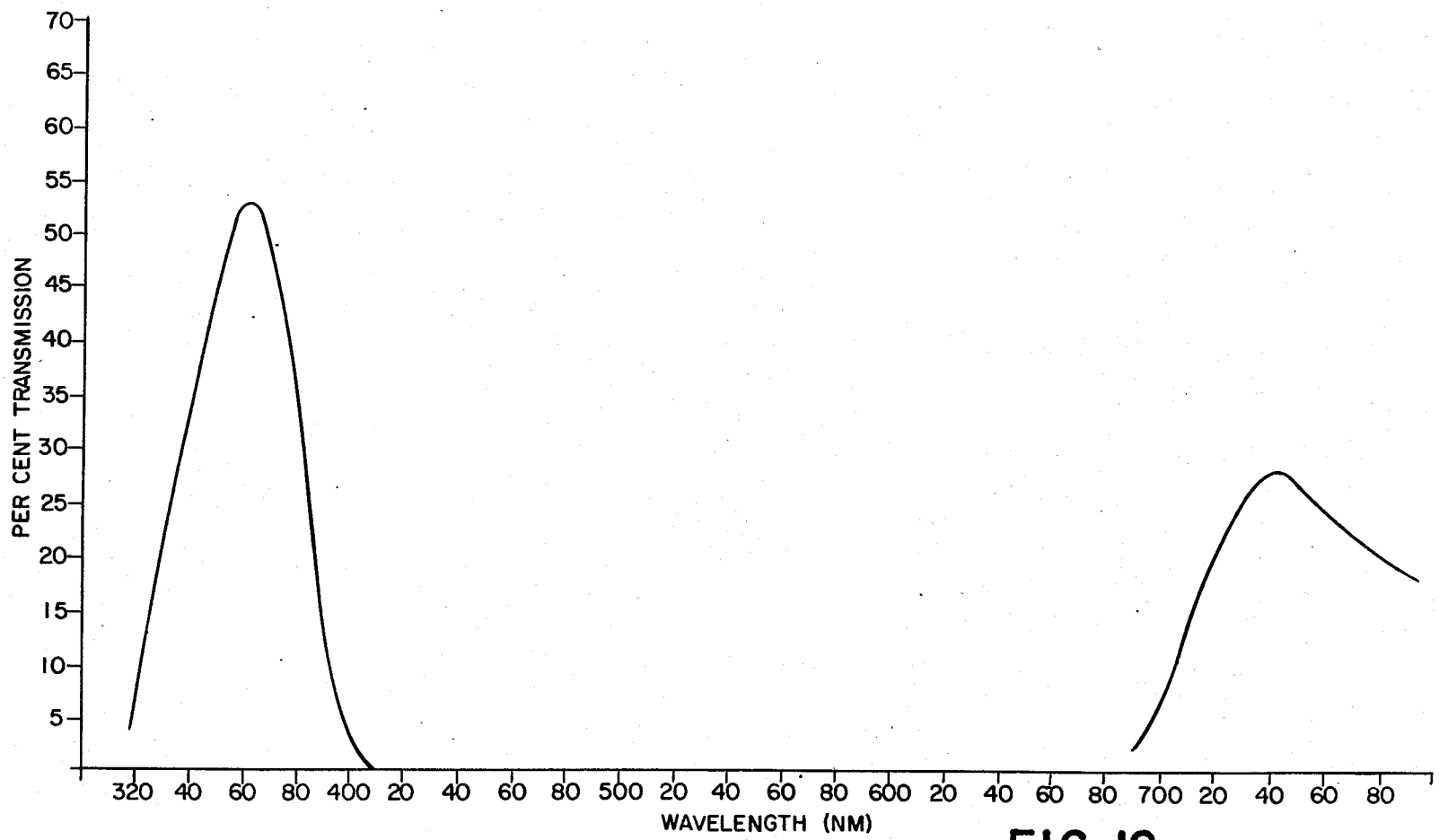
FIG. 12 is a graph showing the spectral transmittance curve of a preferred curing lamp of this invention.

Accordingly, in the preferred application of the process of this invention, a blacklight lamp is used which provides a wavelength of essentially around 360 nm for the curing radiation, visible light, heat and the short and medium wavelength UV being effectively eliminated. More specifically, a blacklight lamp such as would be commercially available, e.g. an industrial UV spot lamp having a 100 watt capacity or rating may be provided with a glass absorption filter of known composition adapted to transmit radiation emanating from the lamp having a spectral transmittance curve exhibiting a peak at about 360 nm and a sharp cut-off with tails extending only to about 320 and about 400. Preferably, the glass absorption filter (e.g. one containing blue-black coloring agents) will, as shown in the transmittance curve of FIG. 12, transmit in excess of 50% of the actinic radiation at the peak of 360 nm; no more than about 20% of the radiation at 330 nm and 390 nm; no more than about 5% of the radiation at 320 nm and 400 nm. In addition, less than 10% of the near infrared below 700 nm will be transmitted. While glass absorption filters which can provide this kind of spectral transmittance will be understood in the optical art and need not be further described in detail, in general a useful glass absorption filter for use with the contemplated curing lamps may be round, have a diameter of about five inches and a sample thickness of about 3/16 inch, and a coefficient of expansion of about $53\times10^{-7}$.

To recapitulate what has been described thus far, the artificial nail process of this invention contemplates the steps of (1) applying to one or more digits a photocurable liquid composition which is dermatologically innocuous and solvent-free, the composition being applied over the natural nail of each such digit and extending beyond, the extension preferably being in the general size and shape of the desired artificial nail; and thereafter (2) exposing the thus applied composition to actinic radiation for a time sufficient to effect curing, thereby forming a water-insoluble, hard, smooth artificial nail which can then, optionally, be subjected to any of the desired finishing touches, e.g. cutting or sanding to final shape, lacquering and the like for appearance, etc. The curing radiation is preferably UV emitted by a blacklight, and most preferably a UV curing radiation as heretofore described precluding any possible undesirable effects, including to persons having supersensitivity to actinic radiation. The photocurable liquid compositions which may be employed to provide artificial nails possessing the desired characteristics are per se known and can therefore be composed of a variety of reagents heretofore employed in the UV-curing polymer art. Typically, such compositions may contain one or more oligomers, a photoinitiator and at least one cross-linkable monomer in which the other named ingredients are soluble. The liquid composition may also contain other desired ingredients, including colorants, as heretofore mentioned.

It is important to note that the present artificial nail process is fully operative in a single coating and curing step, requiring neither a base coat for proper adhesion or any top coat or lacquer to provide required strength or rigidity to the nail. Any coating applied thereover, specifically the nail polishes or lacquers such as those customarily purchased in stores, is only for color and appearance.

Even though the process of this invention is fully operative and useful in a single step, it may be desirable, however, at least in some instances, to apply two or three coating and curing steps for a reason to be described hereinafter and the present invention accordingly contemplates such an additional step or steps.

It has been discovered that, at least in some applications, it may be desired to provide a first coating which is more flexible and will therefore contract and expand more satisfactorily with the underlying natural nail for optimum durability. Such a coating may not, because of its greater flexibility, possess the optimum firmness and rigidity, in which event an additional photocurable coating or two of lesser flexibility may be found advantageous or desirable.

One skilled in the art will readily understand how to vary the liquid coating compositions to provide such variations in rigidity, i.e. how to formulate the first coating composition and any additional ones. As previously explained, rigidity is at least in part a function of the cross-linking which occurs during the curing step and the extent of the cross-linking and thus the degree of rigidity may be varied by such factors as the selection of the particular oligomers and monomers, or mixtures thereof, varying the ratio of oligomer to monomer content, and the selection of monomers which are mono-, di-, or polyfunctional and therefore have varying degrees of reactive sites for cross-linking.

In the known processes for preparing artificial nails directly from liquid coating compositions, including those currently in use commercially in beauty salons and the like, Some kind of form is customarily used to provide the surface extending beyond the natural nail on which the coating is applied. The present process also contemplates the use of such a coating surface and in its broadest aspect any of the known forms such as shown in FIGS. 1 and 2 may be employed according to the novel processes of this invention. However, in the preferred practice, use is made of the novel forms or molds shown in FIGS. 3–11.

Essentially, these novel products are used in the same manner as those known in the art, that is to say, they are placed in position on the digit with the trailing end under the tip of the natural nail. However, unlike the prior forms, e.g. as shown in FIGS. 1 and 2, the novel forms of this invention are adapted to receive a precise amount of the liquid coating composition, thereby minimizing both the time required for the finishing steps of sanding and shaping and also the amount of liquid required to form the artificial nail. In addition, the shaping operation will be done more easily and will require less skill of the operator. These advantages along with the ability to make nails more precisely matching one another in terms of size and shape are siginificant advances in the art. In a preferred embodiment, the novel forms have means permitting adjustment or modification of their shape to conform more closely to the desired shape of the artificial nail, thereby simplifying the variety of different forms that need be kept on hand to accommodate different people.

Figure 3:
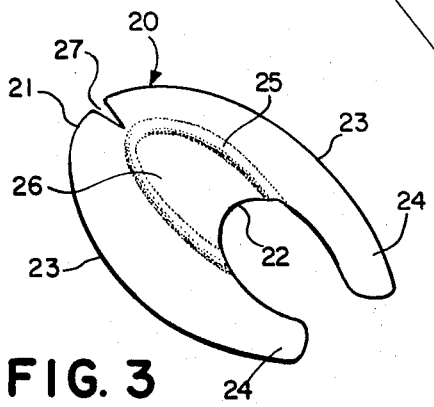
FIG. 3 is a plan view of a novel form or mold of this invention.
Figure 4:
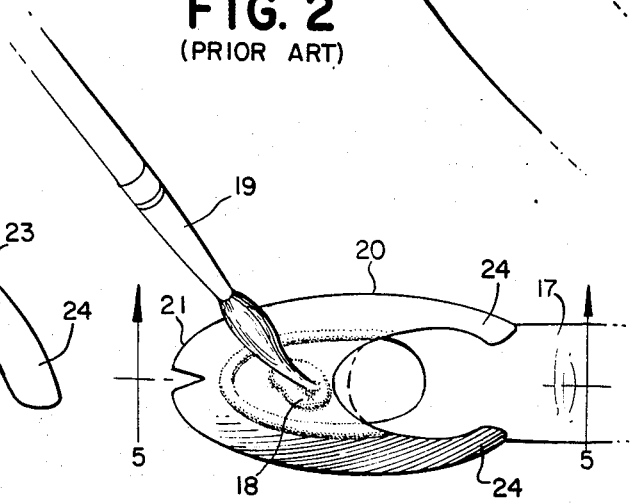
FIG. 4 is top plan view illustrating the preparation of an artificial nail employing the novel structure of FIG. 3.
Figure 5:
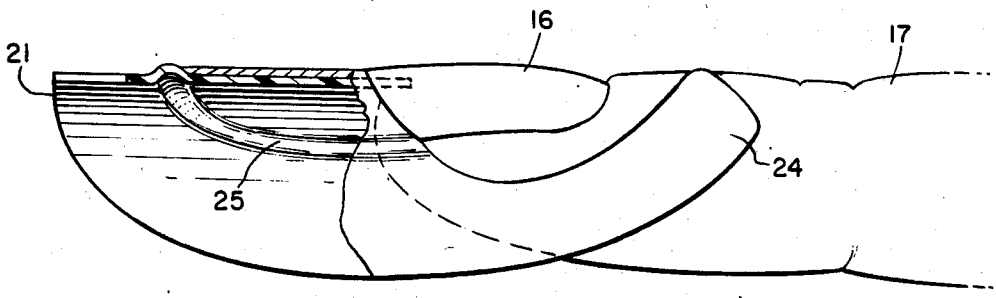
FIG. 5 is a sectional elevation view taken substantially along the line 5—5 of FIG. 4.

FIGS. 3–5 relate to one embodiment of this aspect of the invention.

As shown in FIG. 3, form 20 has a leading end 21, a trailing end 22, lateral edges 23 and fingerlike projections 24 extending from the lateral edges rearwardly from trailing end 22. The leading and trailing ends 21 and 22, respectively, are shown to be generally arcuate, conforming in shape essentially to the normal configuration of the extremity of one's digit. However, since it is the trailing end that is to be placed under the natural nail during use, it will be appreciated that the precise configuration of the leading end is not as important and the leading end may have other configuration.

Projections 24 (much like projections 13 in FIGS. 1–2) are adapted to engage the sides of the digit in order to help retain the form in place during the coating step. An upstanding wall member 25 extending intermediate lateral edges 23 from trailing end 22 towards leading end 21 defines a well or reservoir 26 in the shape of the desired artificial nail. Well 26 is adapted for receiving the coating composition to form the nail. Wall member 25 may be made by creasing or crimping the sheet material in the desired shape or, if desired, a suitable liquid-impermeable material may be adhered by any known adhesive means to the sheet material from which form 20 is made. As with the prior art forms, this sheet material may be any suitable liquid-impermeable material such as metal foil, e.g. aluminum foil, a plastic sheet material such as a polyester, e.g. a 4 mil polyethylene terephthalate sheet, or laminates thereof. Where found desirable or expedient to do so, the surface of form 20 which receives the liquid coating, or at least the portion thereof defining well 26, may be provided with a suitable coating or stripping layer which has a greater adherance for the sheet material than to the coating composition in order to facilitate separation of the cured composition from the form. However, such a stripping layer has not been found necessary.

While not essential or critical to the invention, form 20 has also been shown in the illustrative drawing to be provided at its leading end with a slit 27 to facilitate bending of projections 24 and minor adjustment of the form to accommodate placement in the desired position on the digit. As will be apparent, the underside of form 20 engaging the digit may be provided with a pressure-sensitive adhesive coating (not shown) to obviate accidental movement during the coating operation, thus helping to hold the form more securely in a fixed position on the digit.

While for purposes of illustration, wall member 25 has been shown to extend intermediate lateral edges 23 from the trailing end towards the leading end, it will be appreciated that the configuration of form 20 may be modified so that wall member 25 extends all the way to the lateral edges and/or to the leading end to define the well for receiving the coating liquid in the general shape of the artificial nail extension.

FIGS. 4 and 5 show the novel form of FIG. 3 in use during the coating operation. As shown in FIG. 4, a bead of liquid nail composition 18 is coated with the aid of a suitable applicator 19 which in the drawing is shown to be a brush. Applicator 19 can of course be a stick, blade, or any other suitable means for applying the coating composition. While bead 18 is shown being applied on the form beyond the tip of the natural nail, it can instead be applied on the natural nail first and then forward to fill the well of the form. This would be particularly true when the form is used in conjunction with the aforementioned photocurable compositions which do not require the speed and skill in shaping the coated composition before curing takes place.

Figure 6:
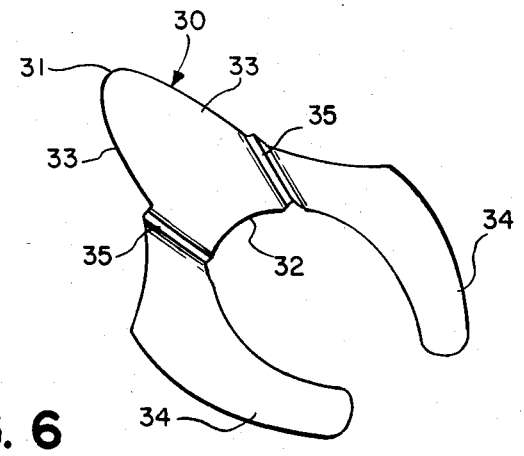
FIG. 6 is a plan view of another form or mold which is contemplated by this invention.
Figure 7:
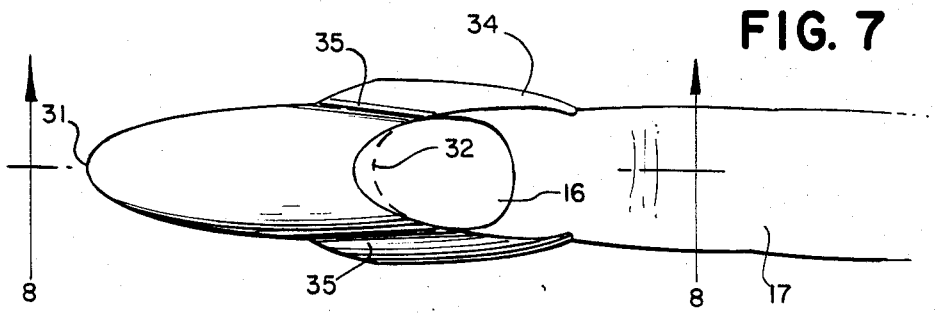
FIG. 7 is a top plan view showing the novel structure of FIG. 6 applied to a finger in preparation for applying an artificial nail coating composition.
Figure 8:
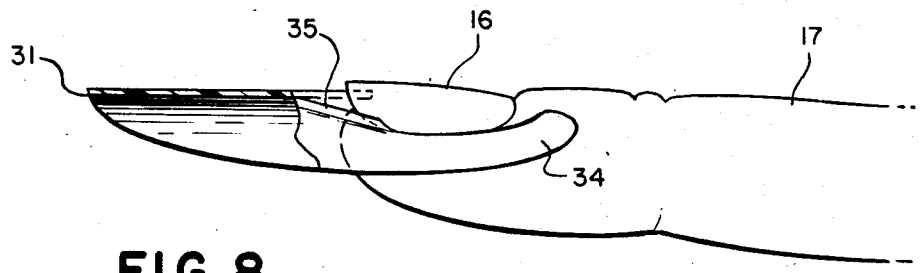
FIG. 8 is a sectional elevation view taken substantially along line 8—8 of FIG. 7.

FIGS. 6–8 illustrate an alternate lesser preferred embodiment of the invention.

As shown in FIG. 6, form 30 has a leading end 31, a trailing end 32, lateral edges 33 and fingerlike projections 34 (similar to projections 13, 24 in the previous figures) extending from the lateral edges rearwardly from trailing end 32. Lateral edges 33 are provided with upstanding wall members 35 at their trailing edges on either side of trailing end 32, which wall members may be provided by creasing or crimping the sheet material employed for form 30 or by adhereing a second sheet material thereto, as previously mentioned in the description of wall member 26. The purpose of wall members 35 is to prevent coating liquid from accidentally flowing onto the respective projections 34 and/or the digit during the coating operation.

The periphery defined by trailing end 32, wall members 35, lateral edges 33 and leading end 31 conforms substantially to the shape desired for the artificial nail and will of course define the portion of the form adapted for receiving the coating composition.

As was previously discussed with respect to the embodiment shown in FIGS. 3–5, the novel form of FIG. 6 may be provided with a pressure-sensitive adhesive layer on its underside as well as with a stripping layer on the opposed side receiving the coating composition, if desired.

In use, the form is placed on digit 17 with the trailing end under the tip of the nail 16 and projections 34 gripping the digit, as was the form of FIGS. 3–5. The coating composition is then applied to the nail as described.

Figure 9:
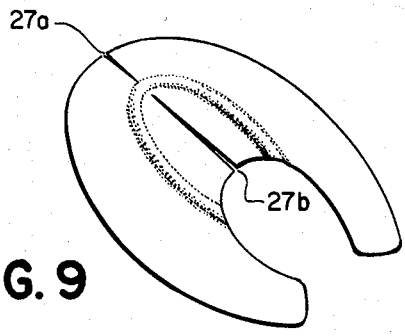
FIGS. 9 and 10 are plan views of an alternate embodiment of the structure of FIG. 3.
Figure 10:
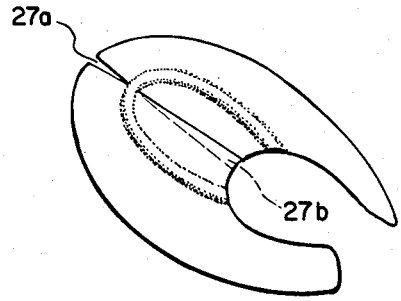
Figure 11:
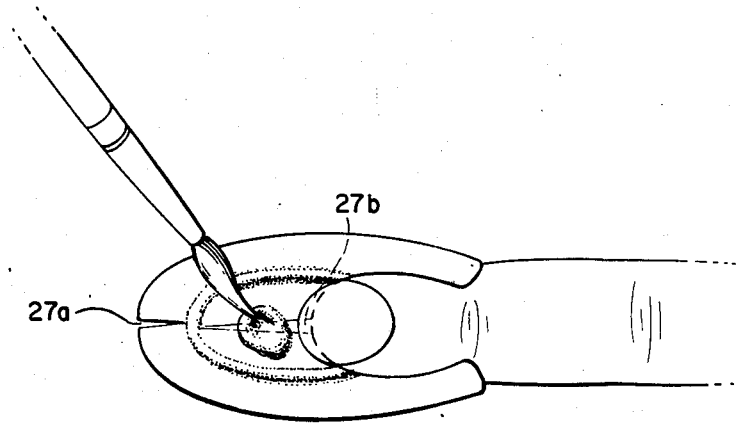
FIG. 11 is a top plan view of the structure of FIGS. 9 and 10 in use.

FIGS. 9–11 relate to a preferred embodiment of the form shown in FIG. 3. In this preferred embodiment, the form 20 of FIG. 3 is provided with one or more sets of slits 27*a* and 27*b* at the leading and trailing ends, respectively, which slits of course do not join so as to sever the form.

The purpose of these slits is to enhance further the adjustability of the form and the configuration of the well 26 (FIG. 3) for receiving the coating liquid. More specifically, the adjustment of the configuration of well 26 in turn modifies the shape of the cured artificial nail to approximate more closely the desired shape, thereby keeping to a minimum the number of different forms that need be at hand to accommodate different size digits.

FIG. 9 shows the form in one position, i.e. as it would be packaged, slit 27*a* at the leading end not being as readily discernible. As the projecting fingers are moved together (FIG. 10), the form tends to separate at its leading end, widening slit 27*a* and causing the section or sections at the trailing end which are separated by slit(s) 27*b* to overlap, thereby modifying somewhat the contour of well 26 and also the spatial relationship of the projecting fingers for engagement with the digit during the coating operation (FIG. 11).

In this preferred embodiment, the underside should be provided with a pressure-sensitive adhesive (as heretofore mentioned) in order to adhere the segments provided by slit(s) 27*b* in overlapping relationship, thereby maintaining the desired alteration in the configuration of the form. In like manner, the adhesive backing will prevent accidental modification of the form from the position shown in FIG. 9, once it is adhered to the digit.

While one set of slits 27*a*, 27*b* has been found to be satisfactory for this purpose, it is envisioned that one practising the invention may wish to provide more than one set of slits and it is expressly understood that while only one set is shown in the drawings, modification to provide a plurality of slits 27*a* and 27*b* according to individual whim is also contemplated and therefore within the scope of the invention.

It will also be understood that various other modifications may be made in the structures shown in FIGS. 3–11 for purposes of illustration without departing from the scope of the invention herein disclosed and defined in the appended claims.

By way of recapitulation, the present invention contemplates both novel processes and novel forms for preparing artificial nails. While they are preferably employed in conjunction with one another, they are nevertheless distinct and separable in the sense that the novel processes may be performed with other forms or coating aids, e.g. the prior art forms; and the novel forms may in turn be employed with the prior art procedures employing liquid coatings which are cured after application to the digit to form the artificial nail.

The claimed processes employ photocurable compositions of the general type known in the art, the essence of the invention, so far as the compositions are concerned, being the recognition or discovery that such compositions may be employed in the expanding artificial nail industry to obviate certain deficiencies common to all the prior commercial techniques known to the applicant.

Specifically, these prior techniques employ compositions wherein curing is initiated in situ substantially immediately upon admixture of the ingredients to form it. In other words, curing starts even before the composition is applied to the digit and is effectively complete to hardness fairly soon thereafter, requiring the operator to move skillfully and rapidly in applying the composition and shaping the nail. Each such nail must therefore be completed sequentially, slowing the productivity of the operator. Further, whereas the claimed process employs solvent-free compositions, the prior techniques use volatile solvents which many find obnoxious and on occasion even cause injury. Other significant benefits are also derived from the present invention. For example, while the prior compositions have been found generally to soften the underlying natural nail, the present compositions do not. The reason for this difference is not presently understood. Moreover, the artificial nails provided by the present invention are characterized as being thinner and more closely approximating the thickness of the natural nail, thereby making them undetectable upon comparison. The fact that the prior compositions provide thicker nails is inherent in their application. Because they cure so rapidly, the operator must first apply a bead on the form and rapidly shape it before it hardens. Subsequent beads are then applied and "feathered" onto the initial coating to make a continuous, smooth, uniform coating. This feathering in turn makes the interface between the hardened prior coating and the newly applied liquid (e.g. the interface between the natural nail and the extension) thicker in appearance than a natural nail of the same length. Since the compositions of the present invention are applied as a continuous coating before curing, this feathering and the resulting thickening is not necessary.

In the process of the present invention, the coating composition is simply applied to one or more digits, as desired, and the coated digit or digits then placed under a suitable lamp adapted for emitting curing radiation at a wavelength which is non-injurious for a short period of time sufficient to effect curing. Suitable curing lamps have been previously described.

The novel forms of this invention, on the other hand, are characterized as having a defined area adapted for receiving the coating composition and which is in general shape and size of the desired nail extension, thereby making it easy to apply the necessary amount of liquid in the right place, minimizing the shaping that is required as well as avoiding the application of excess liquid. In the preferred embodiment, the defined area for receiving the coating composition is a well defined by upstanding wall means. The forms may contain means such as slits which permit adjustment of the shape of the defined liquid-receiving area.

Although the invention has been described in detail in the foregoing specification along with the accompanying drawing with respect to various embodiments thereof, these are intended to be illustrative only and not limiting. One skilled in the art will recognize that various modifications and variations may be made therein which are within the spirit of the invention and the scope of the appended claims.

What is claimed is:

1. Article for preparing artificial nails comprising, in combination:

(1) an organic solvent-free photocurable liquid composition which, upon exposure to actinic radiation, can cure to provide a hard flexible water-insoluble plastic;

(2) a form comprising a liquid-impermeable flexible sheet material adapted to engage a digit and having an area adapted to receive said liquid composition in a defined configuration; and (3) a source of actinic radiation which, upon exposure thereto of said digit having said form containing said composition in engagement therewith, can provide a hard plastic artificial nail.

2. An article as defined in claim 1 wherein said source of actinic radiation is a blacklight lamp which emits radiation characterized as being effectively free of visible light, said emitted radiation being essentially long wavelength ultraviolet.

3. An article as defined in claim 2 wherein said blacklight lamp includes an absorption filter adapted to transmit radiation emanating from said lamp having a spectral transmittance curve exhibiting a peak at about 360 nm and a sharp cut-off with tails extending only to about 320 and about 400 nm.

4. An article as defined in claim 3 wherein said filter is a glass absorption filter containing coloring agents, said filter transmitting in excess of 50 percent of the actinic radiation emanating at about 360 nm, no more than about 20 percent of the radiation emanating at about 330 nm and 390 nm, no more than about 5 percent of the radiation emanating at about 320 nm and 400 nm and less than 10 percent of the near infrared below 700 nm.

5. An article as defined in claim 2 wherein said blacklight lamp comprises an ultraviolet spot lamp having a 100 watt rating, said lamp having a filter adapted to transmit radiation emanating from said lamp having a spectral transmittance curve exhibiting a peak at about 360 nm, said filter being a round glass absorption filter having a coefficient of expansion of about $53\times10^{-7}$.

6. An article as defined in claim 1 wherein said sheet material is provided with a defined liquid receiving area conforming generally to the size and shape of the desired artificial nail.

7. An article as defined in claim 1 wherein said form has an area adapted to receive a precise amount of said liquid composition in a predetermined configuration.

8. An article as defined in claim 7 wherein said form having an area adapted to receive a precise amount of said liquid composition in a predetermined configuration includes an upstanding wall member.

9. An article as defined in claim 8 wherein said upstanding wall member conforms essentially to the shape desired for the artificial nail.

10. An article as defined in claim 1 wherein said sheet material has a leading end, a trailing end and opposed lateral edges, said trailing end being adapted for placement under the tip of the natural nail of a digit, said sheet material having means defining a well extending from said trailing edge intermediate said lateral edges and said leading end, said well being of the general configuration of the desired artificial nail and being adapted to receive a precise amount of said liquid composition.

11. An article as defined in claim 10 wherein said source of actinic radiation is a blacklight lamp which emits radiation characterized as being effectively free of visible light, said emitted radiation being essentially long wavelength ultraviolet.

12. An article as defined in claim 11 wherein said blacklight lamp includes an absorption filter adapted to transmit radiation emanating from said lamp having a spectral transmittance curve exhibiting a peak at about 360 nm and a sharp cut-off with tails extending only to about 320 and about 400 nm.

13. An article as defined in claim 12 wherein said filter is a glass absorption filter containing coloring agents, said filter transmitting in excess of 50 percent of the actinic radiation emanating at about 360 nm, no more than about 20 percent of the radiation emanating at about 330 nm and 390 nm, no more than about 5 percent of the radiation emanating at about 320 nm and 400 nm and less than 10 percent of the near infrared below 700 nm.

14. An article as defined in claim 11 wherein said blacklight lamp comprises an ultraviolet spot lamp having a 100 watt rating, said lamp having a filter adapted to transmit radiation emanating from said lamp having a spectral transmittance curve exhibiting a peak at about 360 nm, said filter being a round glass absorption filter having a coefficient of expansion of about $53\times10^{-7}$.

15. A process for forming a hard artificial nail on a digit, which artificial nail can thereafter optimally be shaped to the desired configuration, comprising the steps of:

(1) applying to a digit an organic solvent-free photocurable liquid composition which upon exposure to actinic radiation can cure to provide a hard flexible water-insoluble plastic and wherein said composition comprises at least one polymer, a photoinitiator and at least one liquid monomer in which said polymer and photoinitiator are soluble, said monomer being cross-linkable with said polymer in the presence of actinic radiation and wherein said polymer is an acrylated urethane oligomer, and (2) thereafter exposing said applied photocurable liquid composition to actinic radiation to initiate said curing to form a hard artificial nail.

16. A process as defined in claim 15 wherein said acrylate urethane oligomer is a low molecular weight oligomer containing no reactive isocyanate groups.

17. A process as defined in claim 16 wherein said acrylated urethane oligomer has a molecular weight in the range of from about 600 to 8000.

18. A process as defined in claim 17 wherein said composition further includes a reagent selected from the group consisting of flow control agents, slip aids, dyes and pigments.

19. A process as defined in claim 15 including the step of inserting under the tip of a natural nail a form or mold of sheet material adapted to receive a predetermined amount of said composition and in a predetermined configuration; and thereafter applying said composition to said form and said natural nail to provide a smooth, uniform continuous layer of artificial nail upon curing of said applied composition.

20. A process as defined in claim 15 wherein said actinic radiation is provided by placing the digit under a blacklight lamp which emits radiation characterized as being effectively free of visible light, heat, and short and medium wavelength ultraviolet light, said emitted radiation being essentially long wavelength ultraviolet.

21. A process as defined in claim 20 wherein said lamp contains an absorption filter which transmits in excess of 50 percent of the asctinic light emanating from said lamp at 360 nm, no more than 20 percent of the radiation emanating at about 330 nm and about 390 nm, no more than about 5 percent of the radiation emanating at about 320 nm and about 400 nm and less than 10 percent of the near infrared below about 700 nm.

22. A process as defined in claim 15 wherein said liquid composition is applied successively to a plurality of said digits and the digits having the thus applied composition are then concurrently exposed to said actinic radiation, whereby to effect simultaneous curing to form said artificial nails on each said digit.

23. A process as defined in claim 15 wherein said composition is characterized as providing upon curing a relatively flexible layer, said process including the further steps of applying at least one additional organic solvent-free photocurable composition to said digit after said first-mentioned composition has been cured, and thereafter curing each said additional composition by successive exposure to actinic radiation, each said additional composition having greater rigidity upon curing than the preceding one.

24. A process as defined in claim 19 wherein said sheet material is provided with a defined liquid receiving area conforming generally to the size and shape of the desired artificial nail tip and said continuous coating is applied substantially only to said natural nail and said defined area.

25. A process as defined in claim 24 wherein said defined area comprises a well defined by upstanding wall means.

26. A process as defined in claim 24 wherein said sheet material comprises a flexible sheet provided with means for adjusting the shape of said liquid-receiving area.

27. A process as defined in claim 26 wherein the means for adjusting the shape of the liquid-receiving area is a slit.

* * * * *